US007090532B1

(12) United States Patent
Kaine

(10) Patent No.: US 7,090,532 B1
(45) Date of Patent: Aug. 15, 2006

(54) ROCKET FOR ELECTRICAL CONNECTORS

(76) Inventor: Michel Kaine, #203-100 Ave. des Sommets, Nun's Island, Quebec (CA) H3E 1Z8

( * ) Notice: Subject to any disclaimer, the term of this patent is extended or adjusted under 35 U.S.C. 154(b) by 0 days.

(21) Appl. No.: 11/097,222

(22) Filed: Apr. 4, 2005

(51) Int. Cl.
*H01R 13/52* (2006.01)

(52) U.S. Cl. ..... 439/523; 439/797

(58) Field of Classification Search ..... 439/523, 439/521, 796–798
See application file for complete search history.

(56) References Cited

U.S. PATENT DOCUMENTS

| | | | | |
|---|---|---|---|---|
| 3,167,374 | A * | 1/1965 | Healy | 439/588 |
| 3,522,578 | A * | 8/1970 | Newman | 439/447 |
| 3,972,415 | A * | 8/1976 | Rohde | 198/359 |
| 4,063,793 | A * | 12/1977 | Judd | 439/588 |
| 4,808,774 | A * | 2/1989 | Crane | 174/135 |
| 5,360,188 | A * | 11/1994 | Condon | 248/56 |
| 5,533,912 | A | 7/1996 | Fillinger | |
| 5,643,009 | A * | 7/1997 | Dinkel et al. | 439/595 |
| 5,711,066 | A * | 1/1998 | Castaldo | 29/855 |
| 5,727,314 | A * | 3/1998 | Ashcraft | 29/884 |
| 5,848,913 | A * | 12/1998 | Ashcraft | 439/521 |
| 5,915,998 | A | 6/1999 | Stidham | |
| 6,017,243 | A * | 1/2000 | Castaldo | 439/462 |
| 6,025,559 | A * | 2/2000 | Simmons | 174/87 |
| 6,325,675 | B1 * | 12/2001 | Harmeyer | 439/709 |
| 6,361,381 | B1 * | 3/2002 | Koebbe | 439/810 |
| 6,688,921 | B1 * | 2/2004 | Borgstrom et al. | 439/798 |
| 6,764,354 | B1 * | 7/2004 | Kaine et al. | 439/793 |
| 6,817,910 | B1 * | 11/2004 | Borgstrom et al. | 439/798 |
| 6,854,996 | B1 * | 2/2005 | Yaworski et al. | 439/276 |
| 6,997,759 | B1 * | 2/2006 | Zahnen et al. | 439/798 |
| 2003/0087552 | A1 * | 5/2003 | Borgstrom et al. | 439/590 |
| 2004/0142588 | A1 * | 7/2004 | Borgstrom et al. | 439/135 |

* cited by examiner

*Primary Examiner*—Ross Gushi

(57) ABSTRACT

A rocket for use with an electrical connector. The rocket is made of suitable resilient material and is used to seal a port through which a conductor passes to connect to the connector. The rocket has a tubular base section that snugly fits within the port, and a longer, tapered, tubular, sealing section extending from one end of the base section. The sealing section is cut through along a line transverse to its longitudinal axis at a location on the section to provide an opening through which a conductor of a specific size, relative to the opening, can pass while expanding a portion of the sealing section adjacent the opening so as to tightly seal it against the conductor.

17 Claims, 1 Drawing Sheet

ROCKET FOR ELECTRICAL CONNECTORS

BACKGROUND OF THE INVENTION

1. Field of the Invention

This invention is directed toward a rocket for use with electrical connectors, and particularly for use with submersible electrical connectors.

2. Description of the Related Art

The electrical connectors are of the type connecting a set of electrical conductors to an electrical conducting block. The block has a first set of holes in one face of the block in which the bare ends of the conductors are inserted, one in each hole. A second set of holes, in a second face of the block transverse to the first face of the block, intersect the first set of holes. The second set of holes are threaded. A set screw is screwed into each hole in the second set of holes to clamp a conductor, in each hole in the first set, to the block to make a good electrical connection between each conductor and the block.

Electrical connectors of the type described above are often used in damp environments or even under water. The connectors are therefore sealed with a plastic casing enclosing the block, the casing having a tubular port surrounding each hole in the block. Each port extends transversely away from the face of the block in which the hole is located. The ports associated with the second set of holes are each sealed with a resilient plug inserted into the port over the set screw in the hole associated with the port. Seals, known as 'rockets', seal the ports through which the conductors pass into the first set of holes.

A rocket is made of resilient material and has a tubular base section that fits snugly within the port, and a tubular, stepped, sealing section extending forwardly from one end of the base section. The steps in the sealing section are each sized to snugly enclose a standard sized conductor. In use, the sealing section of the rocket is cut off at the forward end of the step that is sized to fit the particular size of conductor being used with the connector. The rocket is then mounted by its base snugly within the port and the conductor is passed through the rocket, including the cut step, to make a connection with the connector block. The step tightly encloses the conductor to make the port, with the conductor passing there through into a hole in the first set of holes, watertight. Examples of these rockets are shown in U.S. Pat. Nos. 5,533,912 and 5,915,998 by way of example.

The known rockets however do not always fit all conductor sizes within a range of sizes used in these types of connectors. The known rockets, made in steps, can only handle so many standard sizes without becoming unduly long. Thus, the rockets are either made to have one rocket fit only the more popular standard sizes within a range of sizes, or several rockets must be made to fit all the sizes within the same range of sizes. Further, the known rockets do not always provide a water tight seal, since the steps are usually relatively short in order to accommodate a number of different sized conductors used with the rocket. Also, it is relatively difficult to pass the conductor through the cut step since the step must be expanded a bit to pass the conductor if it is to provide a tight seal against water. The known rockets, particularly with the shorter steps, are also prone to leakage if the conductor must be bent leaving the connector.

SUMMARY OF THE INVENTION

It is the purpose of the present invention to provide a rocket which can accommodate more sizes of conductors within a range of sizes than known stepped rockets. It is another purpose of the present invention to provide a rocket through which a conductor can be relatively easily passed. It is a further purpose of the present invention to provide a rocket which provides a tight seal on the conductor even if the conductor bends leaving the connector. It is yet another purpose of the present invention to provide a rocket which is relatively cheap and of simple design making it easy to manufacture and use.

In accordance with the present invention the rocket is provided with a sealing section which is tapered rather than stepped. Thus the tapered sealing section can be cut at any location along its length to fit any size of conductor within a range of sizes. The tapered rocket is not limited to only those sizes of conductor handled by steps of specific diameter in a stepped rocket. The tapered rocket can handle a greater number of conductors for its length compared to a stepped rocket of the same length. The sealing section is angled to provide a sufficient length for the portion of the sealing section in contact with the conductor so as to provide a good seal on the conductor. It has been found that the portion of the sealing section in contact with the conductor should be at least one quarter inch long to provide a suitable watertight seal about the conductor, assuming of course that the seal is made from a suitable resilient material. The minimum length of one quarter inch can be achieved by providing a taper that provides an included angle between opposed sides of the sealing portion that is around 25°. The taper is shallow enough to provide sufficient length in the contact the portion of the sealing section makes with the conductor yet not so shallow as to make the rocket unduly long.

The invention is particularly directed toward a rocket for use with an electrical connector, the connector having at least one port through which an electrical conductor is inserted to connect with the connector. The rocket is made of suitable resilient material and is used to seal the port. The rocket has a tubular base section that snugly fits within the port, and a longer, tapered, tubular, sealing section extending from one end of the base section, the sealing section tapering down towards its free end. The base and sealing sections have a common longitudinal axis. The sealing section is adapted to be cut through along a line transverse to the longitudinal axis at a location on the section to provide an opening through which a conductor of a specific size, related to the opening, can pass while expanding a portion of the sealing section adjacent the opening.

DESCRIPTION OF THE PREFERRED EMBODIMENTS

Figure 1:
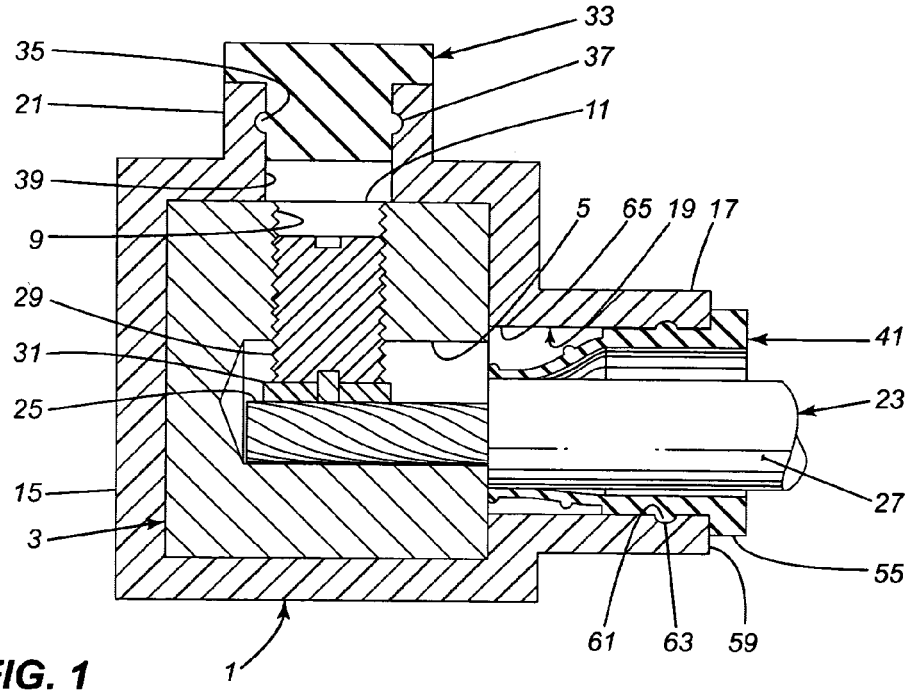
FIG. 1 is a cross-section view of the connector with a conductor mounted therein, the conductor sealed by a rocket.

The electrical connector 1 comprises an electrical conducting block 3 having a first set of holes 5 (one shown) in one face 7 of the block 3 and a second set of holes 9 (one shown) in a second face 11 of the block which second face is transverse to the first face 7. The first set of holes 5 are intersected by the second set of holes 9.

For use in a wet environment, where the connector can even be submerged in water, the block is enclosed by an elastomeric casing 15, the casing having a first set of entry ports 17, one port 17 surrounding each hole 5 in the first set of holes and extending away from the one face 7. The interior 19 of each port 17 is slightly larger than the hole 5 it is associated with. The casing 15 has a second set of entry ports 21, one port 21 surrounding each hole 9 in the second set of holes and extending away from the second face 11.

A conductor 23 is adapted to be mounted in each hole 5 in the first set of holes, the conductor 23 passing through the port 17 in the casing 15 into the hole 5. The free end 25 of the conductor 23 is bare of insulation 27. A set screw 29 is threadably mounted in each hole 9 in the second set of holes to intersect the free end 25 of the conductor 23 and lock it securely in place in the hole 5 to the block 3. An adapter 31, connected to the end of the set screw 29, may be used to help locate the conductor 23 within the hole 5, the adapter 31 pushing the free end 25 of the conductor 23 against the wall of the hole 5.

The threaded holes 9 receiving the set screws 29 can be made watertight with a resilient plug 33 plugged into each port 21. The plug 33 can be locked in the port 21 with a rib 35 on the plug 33 entering a groove 37 on the inner wall 39 of the port 21.

In an alternative embodiment, the set screw itself can be constructed to provide a sealing function for the port 21. In this embodiment, the threaded hole 9 is the same size as the port 21. The set screw has a threaded bottom portion for passing through the port 21 and threading into the hole 9, and a ribbed upper portion for sealing with the port 21. The top portion of the screw can project from the top of the port 21. The ribbed upper portion can have two or more ribs for sealing cooperation with the interior of the port 21.

Figure 2:
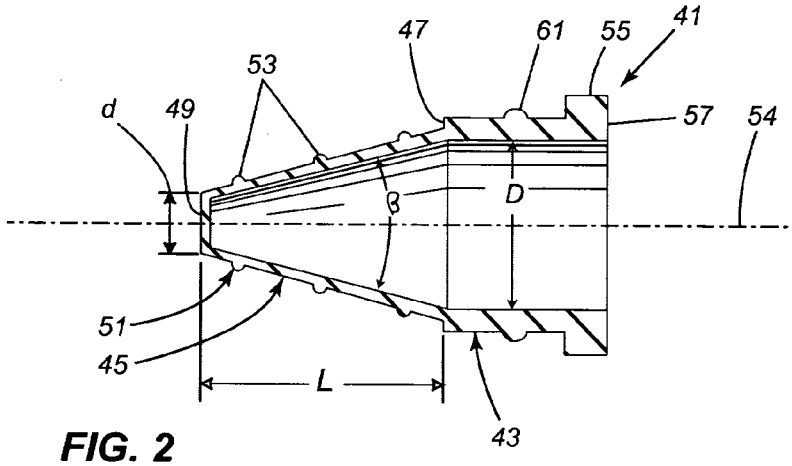
FIG. 2 is cross-section view of the rocket.

A rocket 41 is used to seal the ports 17 through which the conductors 23 pass. As shown in FIG. 2, the rocket 41 has a tubular base section 43 and a tapered sealing section 45 extending forwardly from one end 47 of the base 43. The base section 43 gas an annular cross-section. The tapered sealing section 45 has a length 'L' about one and half times as long as the diameter 'D' of the base section 43. The leading end 49 of the sealing section 45 is closed and planar and its diameter 'd' is normally sized to have the rocket handle the conductor with the smallest diameter that might be used with the connector.

The sealing section 45 can, if desired, have locating means 51 on its periphery at locations indicating where the sealing section should be cut to have the rocket seal a specific size of conductor. The locating means 51 can comprise small locating ribs 53 about the periphery of the sealing section at longitudinally spaced-apart locations along its length, each rib 53 at a location indicating where the sealing section should be cut for a specific size of conductor. The locating ribs 53 extend transverse to the longitudinal axis 54 of the rocket. Indicia can be provided on the sealing section adjacent each rib 53 indicating the size of conductor the rib is associated with. The ribs 53 could be dispensed with and only the indicia could be used.

The base section 43 of the rocket can have a flange 55 at its free end 57 for abutting on the free end 59 of the conductor port 17. The base section 43 can also have a connecting rib 61 adjacent the free end 57 for cooperating with a groove 63 formed on the inside wall 65 of the port 17 to lock the rocket 41 to the port 17 when installed therein. More than one cooperating connecting rib/groove arrangement can be provided on the base section/port.

Figure 3:
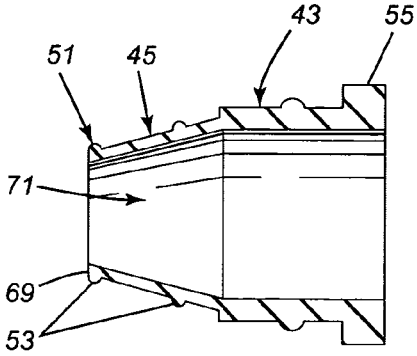
FIG. 3 is a cross-section view of the rocket cut to fit a particular size of conductor with conductor positioned to be mounted.
Figure 4:
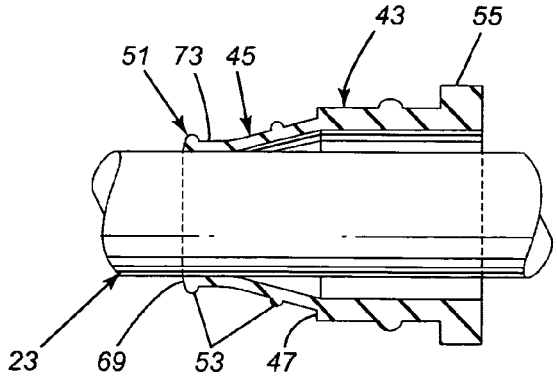
FIG. 4 is cross-section view showing the rocket mounted on the conductor in sealing relationship.

To use the rocket, the sealing section 45 is cut at a rib location to receive a specific size of conductor 23 as shown in FIG. 3. The location of the cut to produce a cut end 69, for the specific size of conductor used, is such that conductor 23 will make tight contact with the rocket during insertion through the rocket and out the opening 71 in the cut end 69 as shown in FIG. 4. The cut end 69 is located to have at least a quarter of an inch of length of the sealing section 45 of the rocket, starting from the cut end 69, make sealing contact with the conductor. This length of sealing section provides a sealing portion 73 which expands to tightly seal against the conductor making the entry of the conductor into the port watertight. While the cut has been made at a specific location, the location can vary slightly in either longitudinal direction because of the tapered shape and the resiliency of the material. The cut does not have to be exact making installation easier.

The sealing section 45 of the rocket 41 is tapered to have an included angle β of about 25° between opposed sides of the sealing section. The angle could be slightly less if it is desired to have a longer sealing portion 73 of the sealing section 45 contact the conductor. The included angle β could range between about 20° and 30° depending on the material of the rocket and the configuration of the conductors (bent or straight leaving the port) and still provide good sealing on the conductor.

The locations provided by the locating ribs 51 on the sealing section 45 of the rocket can be replaced by depressions, or by any other suitable marking, defined by physical characteristics or other means. Other locations for cutting the sealing section 45 could be extrapolated between the existing locating ribs.

The rocket is made from suitable elastic material such as natural or synthetic rubber, the synthetic rubber selected from neoprene, santoprene nitrile or the like.

While the sealing section 45 of the rocket 41 has been shown as extending directly away from the one end 47 of the base section 43, it could extend from within the base toward the one end 47, starting close to the flange 55 on the base section 43. This would shorten the rocket making it more compact and saving space. The shorter rockets are used with connectors having larger ports 17.

The rockets have been described being used with conductors. The rockets can also be used to seal unused ports 17 that do not receive a conductor. The closed end on the rocket allows this use.

While the invention has been described for use with set screw connector it can also be used with other types of electrical connectors such as busbars.

I claim:

1. A rocket for use with an electrical connector, the connector having at least one port through which an electrical conductor is inserted to connect with the connector; the rocket made of suitable resilient material and used to seal the port; the rocket having a tubular base section that snugly fits within the port, and a longer, uniformly tapered, tubular, sealing section extending from one end of the base section; the base and sealing sections having a common longitudinal axis; the sealing section adapted to be cut through along a line transverse to the longitudinal axis at a location on the section to provide an opening through which a conductor of a specific size, relative to the opening, can pass while expanding a tapered portion of the tapered section adjacent the opening, the expanding tapered portion enveloping the conductor with increasing pressure toward the opening.

2. A rocket as claimed in claim 1 including a flange on the free end of the base section for abutting the end of the port when the rocket is inserted into the port.

3. A rocket as claimed in claim 1 wherein the sealing section of the rocket extends from deep within the base toward the one end of the base.

4. A rocket as claimed in claim 1 wherein the sealing section has longitudinally spaced-apart locating means along its length to indicate where to cut for at least some of the conductors used with the connector.

5. A rocket as claimed in claim 4 wherein the locating means comprise ribs on the sealing section extending about the section and transverse to the longitudinal axis.

6. A rocket as claimed in claim 1 wherein the sealing section has a taper to provide an included angle between opposed sides of the sealing section that ranges between 20° and 30°.

7. A rocket as claimed in claim 6 including a flange on the free end of the base section for abutting the end of the port when the rocket is inserted into the port.

8. A rocket as claimed in claim 6 wherein the sealing section has longitudinally spaced-apart locating means along its length to indicate where to cut for at least some of the conductors used with the connector.

9. A rocket as claimed in claim 8 wherein the locating means comprise ribs on the sealing section extending about the section and transverse to the longitudinal axis.

10. A rocket as claimed in claim 1 wherein it in made of resilient material, and has a taper, such that the expandable portion of the sealing section is at least one quarter of an inch long.

11. A rocket as claimed in claim 10 including a flange on the free end of the base section for abutting the end of the port when the rocket is inserted into the port.

12. A rocket as claimed in claim 10 wherein the sealing section has longitudinally spaced-apart locating means along its length to indicate where to cut for at least some of the conductors used with the connector.

13. A rocket as claimed in claim 12 wherein the locating means comprise ribs on the sealing section extending about the section and transverse to the longitudinal axis.

14. A rocket as claimed in claim 10 wherein the sealing section has a taper to provide an included angel between opposed sides of the sealing section that ranges between 20° and 30°.

15. A rocket as claimed in claim 14 including a flange on the free end of the base section for abutting the end of the port when the rocket is inserted into the port.

16. A rocket as claimed in claim 14 wherein the sealing section has longitudinally spaced-apart locating means along its length to indicate where to cut for at least some of the conductors used with the connector.

17. A rocket as claimed in claim 16 wherein the locating means comprise ribs on the sealing section extending about the section and transverse to the longitudinal axis.

* * * * *